US006997516B2

(12) United States Patent
Lan

(10) Patent No.: US 6,997,516 B2
(45) Date of Patent: Feb. 14, 2006

(54) CONVERTIBLE SEAT WITH CONTOURED-FRONT FOR LOCALIZED BODY HEAT DISPERSION AND PRESSURE REDUCTION

(76) Inventor: Jianqing Lan, 12129 Red Admiral Way, Germantown, MD (US) 20876

( * ) Notice: Subject to any disclaimer, the term of this patent is extended or adjusted under 35 U.S.C. 154(b) by 0 days.

(21) Appl. No.: 11/070,372

(22) Filed: Mar. 2, 2005

(65) Prior Publication Data

US 2005/0225154 A1 Oct. 13, 2005

Related U.S. Application Data

(62) Division of application No. 10/225,931, filed on Aug. 22, 2002, now Pat. No. 6,880,885.

(51) Int. Cl.
*A47C 7/02* (2006.01)

(52) U.S. Cl. ..... 297/452.23; 297/452.24

(58) Field of Classification Search ..... 297/202, 297/452.23, 452.24, 452.26
See application file for complete search history.

(56) References Cited

U.S. PATENT DOCUMENTS

| | | | | | |
|---|---|---|---|---|---|
| 859,828 | A * | 7/1907 | McCloud | 297/452.46 |
| 1,538,542 | A * | 5/1925 | Blake | 297/202 |
| 2,199,479 | A * | 5/1940 | Cappel | 5/637 |
| 2,855,986 | A | 10/1958 | Engelen, Sr. | |
| 4,132,228 | A * | 1/1979 | Green | 601/57 |
| 4,718,727 | A * | 1/1988 | Sheppard | 297/452.26 |
| 4,824,174 | A | 4/1989 | Dunn, Sr. | 297/452.46 |
| 4,946,220 | A | 8/1990 | Wyon et al. | 297/180.13 |
| 5,382,075 | A | 1/1995 | Shih | 297/180.4 |
| 5,568,664 | A | 10/1996 | Lin | 5/652 |
| 5,597,200 | A | 1/1997 | Gregory et al. | 297/180.13 |
| 5,857,749 | A | 1/1999 | DeBellis et al. | 297/452.41 |
| 5,873,626 | A * | 2/1999 | Katz | 297/202 |
| 5,979,989 | A * | 11/1999 | Herbst | 297/452.22 |
| 6,125,486 | A | 10/2000 | Rabon | 5/654 |
| 6,193,309 | B1 * | 2/2001 | Gootter et al. | 297/202 |
| 6,224,151 | B1 * | 5/2001 | McMullen, Jr. | 297/202 |
| 6,224,623 | B1 | 5/2001 | Augustine et al. | 607/104 |
| 6,250,719 | B1 | 6/2001 | Gebhardt | 297/452.48 |
| 6,450,572 | B1 * | 9/2002 | Kuipers | 297/195.1 |

* cited by examiner

*Primary Examiner*—Peter M. Cuomo
*Assistant Examiner*—Sarah B. McPartlin

(57) ABSTRACT

A seat (chair, stool, etc.) has a seat base with a contoured front that is recessed in the middle. The recess extends towards a seating center and/or in a downward direction, creating an open area for a seated person. The open area is located under the body part around the testes of a seated male person so that the dispersion of body heat from that area via air circulation will not be blocked by the seat base, and at the same time, the pressure between the testes area and the seat base will be reduced or eliminated, thereby improving the physiological condition for sperm, and in turn, may increase sperm activity and may reduce the possibility of infertility. A mobile recessed part that can be moved in and out of the open area in the seat base makes the seat convertible.

13 Claims, 2 Drawing Sheets

CONVERTIBLE SEAT WITH CONTOURED-FRONT FOR LOCALIZED BODY HEAT DISPERSION AND PRESSURE REDUCTION

This is a division of application Ser. No: 10/225,931, filed Aug. 22, 2002 now U.S. Pat. No. 6,880,885.

FEDERALLY SPONSORED RESEARCH

Not Applicable

SEQUENCE LISTING OR PROGRAM

Not Applicable

BACKGROUND

1. Field of Invention

This invention relates to a seating device that helps localized body heat dispersion and pressure reduction, specifically from under testes area of a seated male person.

2. Description of Prior Art

Infertility affects about one of every five couples in the United States (THE MERCK MANUAL-Home Edition, Sec. 22, Ch. 240, 2001). One of the major causes of infertility is sperm problem, which counts for 30 to 40 percent of all infertility cases. It is known that increased testicular temperature causes sperm cell abnormality or death, and will result in lowered fertility if prolonged.

Men who regularly sit for long periods of time (such as office workers, college students, etc.) may have higher temperature around testes due to the fact that seating material blocks body heat dispersion from that area. Pressure between body part and seat base also affects blood or other body system circulation around that area, which may also have an adverse effect on sperm normality.

The problem of infertility related to seating was not recognized in prior art. The closest known prior art was for general seat cooling or heat dispersion. Some have apertures (small holes) in the bottom or back of a seating device. Some others have air duct/channel(s) under the whole seating part, some combine with power fan, air permeable material, or the similar. None of these prior-art approaches intended specifically to disperse body heat or reduce pressure from around testes area of a seated male person. Even for general cooling it is not effective (such as small holes) and is impractical and costly (such as air duck, power system). For example, U.S. Pat. No. 5,597,200 to Gregory, et al. (1997) discloses a device for a vehicle seat that can cool the whole seat. However it is neither for localized cooling nor for pressure reduction at the front middle of a seat base. Furthermore it needs an air duct, permeable seating material and conditioned air from a central source in the vehicle, which is not practical for office chairs. U.S. Pat. No. 5,382,075 to Shih (1995) shows a ventilation device for a chair seat, which has a motor, fan, vent port, and a plurality of air guide plates. It is designed for general seat ventilation, but is neither for localized air circulation nor for pressure reduction at the front middle of a seat base. It is also complicated and costly compared to conventional chairs. As another example, U.S. Pat. No. 4,132,228 to Green (1979) reveals a seat cushion assembly with some layers specially designed for even pressure distribution. But it is not for pressure elimination especially under the testes area of a seated male person. Furthermore a better fit of the seat cushion assembly (which has a layer of resilient foam material without hole) into the gluteal region of a seated person might well cause the temperature around the testes area to increase because of the lack of direct airflow.

BRIEF SUMMARY OF THE INVENTION

This seat design creates an opening in the seat base (or seating part) under testes area of a seated male person, so that the dispersion of body heat from that area via air circulation will not be blocked by the seat base, and at the same time the pressure between testes area and the seat base will be reduced or eliminated, thereby improving physiological condition for sperms, and in turn may increase sperm activity and may reduce the possibility of infertility.

This seat design is also very easy to be reduced to practice, and has no complicated machinery comparing to other cooling seat devices. It uses little additional material and has little additional cost comparing to conventional seating devices. It is also very easy to use, nothing special to turn on or no complicated system to operate.

BRIEF DESCRIPTION OF THE SEVERAL VIEWS OF THE DRAWING

Drawing Figures

DETAILED DESCRIPTION OF THE INVENTION

Figure 1A:
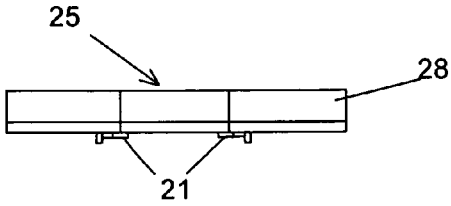
FIG. 1A is a front view of the chair in FIG. 1, without showing a chair back and chair legs. Part 25 is up and is locked by latch 21.
Figure 1B:
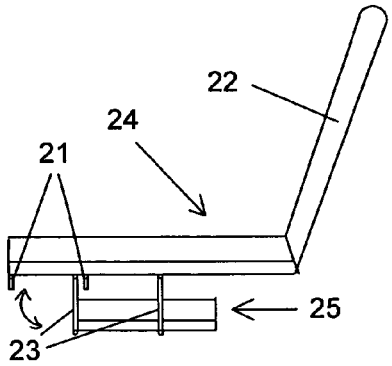
FIG. 1B is a site view of the chair in FIG. 1, without showing chair legs. Part 25 is at down position.
Figure 1:
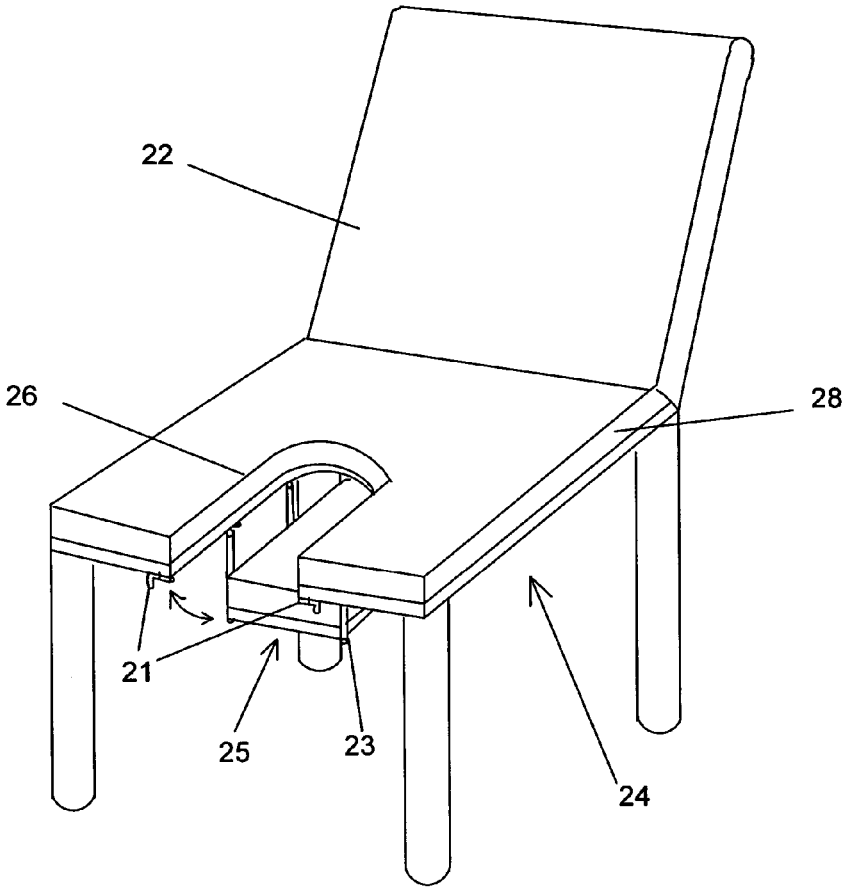
FIG. 1 is a perspective view of an embodiment of a chair with a contoured front at a seat base resulted from folding down a corresponding part at the seat base.

FIG. 1 illustrates one of the embodiments of the invention. A seat (chair, stool, etc.) has a contoured front of seat base 24 so that the mentioned front recessed in the middle towards seating center and downward, creating an open area 26 for a seated person, which is under the body part around the testes of a seated male person. A mobile recessed part 25 offers a conversion between the above-mentioned structure and common structure of a conventional seat. This is achieved through a simple folding mechanism as shown in FIG. 1. Part 25 is made in the same way (soft padding 28 on top of rigid seat base) as other part of the seat base 24. Part 25 is connected to part 24 using lever hinges 23 or the similar. Part 25 has a shape that fits the cut-open area 26 in the front middle of seat base 24, so that when part 25 aligns with the rest of seat base 24 and is locked by latches 21 (or similar devise) the seat is similar to a conventional chair (FIG. 1A). When localized body heat dispersion and/or pressure relief is desired, latches 21 can be released and part 25 can be pressed down or moved away by other means to create the opening.

In FIG. 1 and FIG. 1B the curved double-arrow sign indicates the movement direction of the folding.

Seat back 22 and padding 28 are optional. So are arms or other accessories (not shown).

Figure 2A:
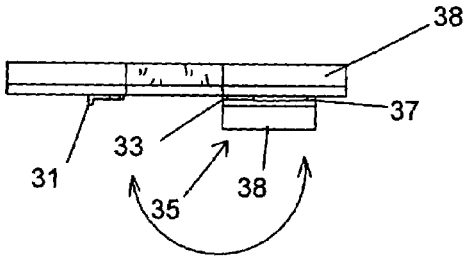
FIG. 2A is a front view of the chair in FIG. 2, without showing a chair back and chair legs. Part 35 is flipped over and is held by catch 37.
Figure 2B:
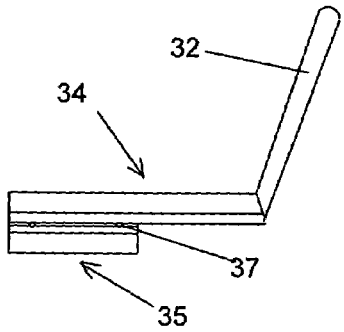
FIG. 2B is a site view of the chair in FIG. 2, without showing chair legs. Part 35 is at flipped over position.
Figure 2:
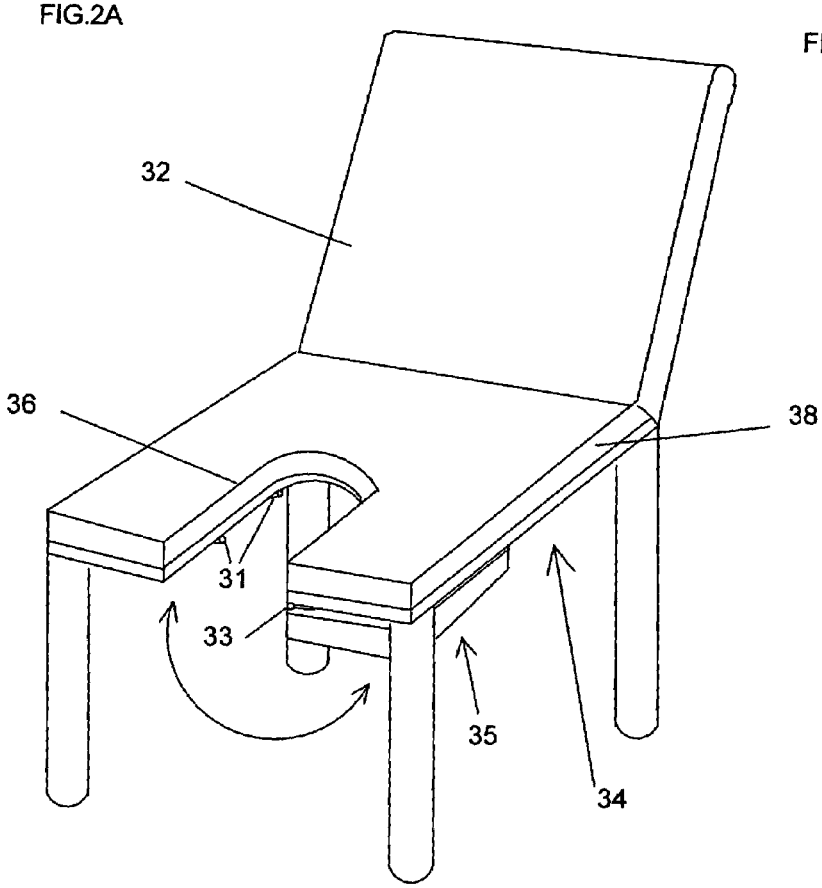
FIG. 2 is a perspective view of an alternate embodiment of a chair with a contoured front at a seat base resulted from flipping over a corresponding part at the seat base.

Another embodiment of the invention is shown in FIG. 2. Similar to FIG. 1, it can convert between conventional chair and a chair with an opening in the front middle of seat base 34. What is different in this embodiment is that the conversion is achieved through flip-over of part 35 that fits the shape of open area 36 and connects to the rest of seat base 34 by hinges 33 (or similar devise). Part 35 can be locked in non-opening position by latches 31 (or similar devise) to form a conventional chair and can be locked in opening position by catches 37 (or similar devise) to create the opening in the seat base.

In FIG. 2 and FIG. 2A the curved double-arrow sign indicates the movement direction of the flipping. Flipping can be toward other directions under the seat base.

Seat back 32 and padding 38 are optional. So are arms or other accessories (not shown).

Other ramifications: Creating of above-mentioned opening in a seat base at its front middle can also be achieved through sliding, detaching, or similar means, of the corresponding part at the front middle of the seat base.

Instead of creating an open area in the seat base by changing the shape of its rigid part, one can just cut out a corresponding area of the padding if it is a thick one to create a not-so-obvious open area. Additionally one can make apertures of enough size in that rigid part of the seat base or one can use good heat conducting material (such as aluminum) to replace original material (wood, or synthetic material) for rigid part in that area of seat base. Heat from body part around testes can be dispersed through airflow or can be transferred to heat conducting material and dispersed through the other side (underneath). Adding cooling fins underneath can assist heat dispersion.

The new design disclosed in this invention can be applied to various seating devices, including those portable, with removable part(s), folding, stacking, collapsible, with interchangeable part(s), convertible, with detachable part(s), combined with other device(s), supplemental seating devices.

The invention has been described in detail with specific embodiments thereof, but it is evident that variations and modifications can be effected within the spirit and scope of the invention.

What I claim as my invention is:

1. A seat for localized body heat dispersion and pressure reduction under a seated male person's testes area, said seat comprising:

(a) a seat base comprising a layer of rigid material extending to a sufficient size to support a seated person's whole buttocks, said seat base having opposing right and left edges that connect at a rear edge;

(b) a contoured front of said seat base opposing said rear edge, said contoured front extending from said right edge to said left edge and being recessed in a middle of said contoured front of said seat base;

(c) an elongated open area in said middle of said contoured front extending for a partial length toward said rear edge, said open area being under a seated male person's testes area whereby body beat dispersion from said open area is not obstructed at downward and forward directions;

(d) said open area being substantially larger than an area corresponding to a seated male person's testes and subazantially smaller than an area corresponding to a person's buttocks;

(e) a right side and a left side of said seat base flanking said open area, each of said right and left sides having a width from right to left thereof being greater than a width from right to left of said open area;

(f) said seat base having every part thereof lower than any part of a seated person's buttocks and upper thighs during usage of said seat;

(g) a recessable part having an approximate size of said open area in said seat base;

(h) said recessable part being moveably attached to said seat base in a way so that at one position said recessable part is in said open area and is aligned with said seat base, while at another position said recessable part is out of said open area of said seat base.

2. The seat of claim 1 wherein said elongated open area extends in one dimension for a partial length from said front towards said rear edge viewing from a top of said seat base.

3. The seat of claim 2, further including means for attaching said recessable part to said seat base for making said recessable part mobile.

4. The seat of claim 3 wherein said means comprising pivotal, sliding, depressible, or draggable ways.

5. The seat of claim 3 wherein said recessable part is attached to said seat base so that when said recessable part is moved into said open area of said seat base it is aligned with said seat base.

6. The seat of claim 5, further including means for locking said recessable part when said recessable part is moved into said open area and is aligned with said seat base.

7. The seat of claim 3, further including means for catching said recessable part when said recessable part is moved away from said open area of said seat base.

8. The seat of claim 3 wherein said recessable part being substantially parallel to said seat base when said recessable part is moved away from said open area.

9. The seat of claim 8 wherein said recessable part having a surface substantially lower than the surface of said seat base when said recessable part is moved away from said open area and is directly under said open area.

10. The seat of claim 2, further including a layer of padding on top of said layer of rigid material wherein said open area is formed from moving away a portion of said layer of padding having a shape corresponding to said open area.

11. The seat of claim 10, further including a plurality of apertures of sufficient size in the corresponding portion of said layer of rigid material to let air flow freely.

12. A method for converting between a structure of a seat base having no contoured front and a structure of a seat base having a contoured front that is recessed in the middle for localized body heat dispersion and pressure reduction under a seated male person's testes area, said method comprising the steps of: providing (a) a seat base comprising a layer of rigid material extending to a sufficient size to support a seated person's whole buttocks, said seat base having opposing right and left edges that connect at a rear edge;

(b) a contoured front of said seat base opposing said rear edge, said contoured front extending from said right edge to said left edge and being recessed in a middle of said contoured front of said seat base;

(c) an elongated open area in said middle of said contoured front extending for a partial length toward said rear edge, said open area being under a seated male person's testes area whereby body heat dispersion from said open area is not obstructed at downward and forward directions;

(d) said open area being substantially larger than an area corresponding to a seated male person's testes and substantially smaller than an area corresponding to a person's buttocks;

(e) a right side and a left side of said seat base flanking said open area, each of said right and left sides having a width from right to left thereof being greater than a width from right to left of said open area;

(f) said seat base having every part thereof lower than any part of a seated person's buttocks and upper thighs during usage of said seat;

(g) a recessable part having an approximate size of said open area in said seat base;

(h) said recessable part being moveably attached to said seat base in a way so that at one position said recessable part is in said open area and is aligned with said seat base, while at another position said recessable part is out of said open area of said seat base;

releasing said recessable part in said front middle of said seat base wherein said recessable part is separate but has been securely connected to and aligned with said seat base;

moving said recessable part away from said front middle of said seat base to create an open area in said front middle of said seat base.

13. The method in claim 12, further including a step of catching said recessable part under said seat base.

* * * * *